US009841229B2

(12) United States Patent
Bauer et al.

(10) Patent No.: US 9,841,229 B2
(45) Date of Patent: Dec. 12, 2017

(54) PROCESS FOR COOLING A HYDROCARBON-RICH FRACTION

(71) Applicants: Heinz Bauer, Ebenhausen (DE); Claudia Gollwitzer, Munich (DE)

(72) Inventors: Heinz Bauer, Ebenhausen (DE); Claudia Gollwitzer, Munich (DE)

(73) Assignee: Linde Aktiengesellschaft, Munich (DE)

( * ) Notice: Subject to any disclaimer, the term of this patent is extended or adjusted under 35 U.S.C. 154(b) by 264 days.

(21) Appl. No.: 14/810,944

(22) Filed: Jul. 28, 2015

(65) Prior Publication Data

US 2016/0054053 A1 Feb. 25, 2016

(30) Foreign Application Priority Data

Aug. 19, 2014 (DE) ..... 10 2014 012 316

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0052* (2013.01); *F25J 1/0092* (2013.01); *F25J 1/0097* (2013.01); *F25J 1/0212* (2013.01); *F25J 1/0263* (2013.01); *F25J 1/0288* (2013.01); *F25J 1/0294* (2013.01); *F25J 2270/16* (2013.01)

(58) Field of Classification Search
CPC ..... F25J 1/0022; F25J 1/0072; F25J 1/0092; F25J 1/0292; F25J 1/005; F25J 1/0212; F25J 2270/16; F25J 2270/18; F25J 2270/66
See application file for complete search history.

(56) References Cited

U.S. PATENT DOCUMENTS

| | | | | |
|---|---|---|---|---|
| 3,919,852 | A * | 11/1975 | Jones | F25J 1/0025 60/651 |
| 5,768,912 | A | 6/1998 | Dubar | |
| 6,412,302 | B1 | 7/2002 | Foglietta | |
| 2010/0122551 | A1* | 5/2010 | Roberts | F25J 1/0022 62/613 |
| 2010/0154470 | A1* | 6/2010 | Nilsen | F25J 1/0022 62/613 |
| 2011/0168377 | A1* | 7/2011 | Alers | F25B 9/006 165/200 |

* cited by examiner

*Primary Examiner* — Brian King
(74) *Attorney, Agent, or Firm* — Philip H. Von Neida

(57) ABSTRACT

A process for cooling a hydrocarbon-rich fraction, in particular natural gas, against a refrigerant circuit. In this process, the compressed refrigerant is divided into three refrigerant substreams. Whereas the first substream is work-producingly expanded in a warm expander and the second substream is work-producingly expanded in a cold expander, the third substream is work-producingly expanded at the lowest temperature level. The result therefrom is that the operating point of the cold expander is shifted in such a manner that the refrigeration output of the two expanders is situated in a ratio between 40/60 and 60/40.

10 Claims, 1 Drawing Sheet

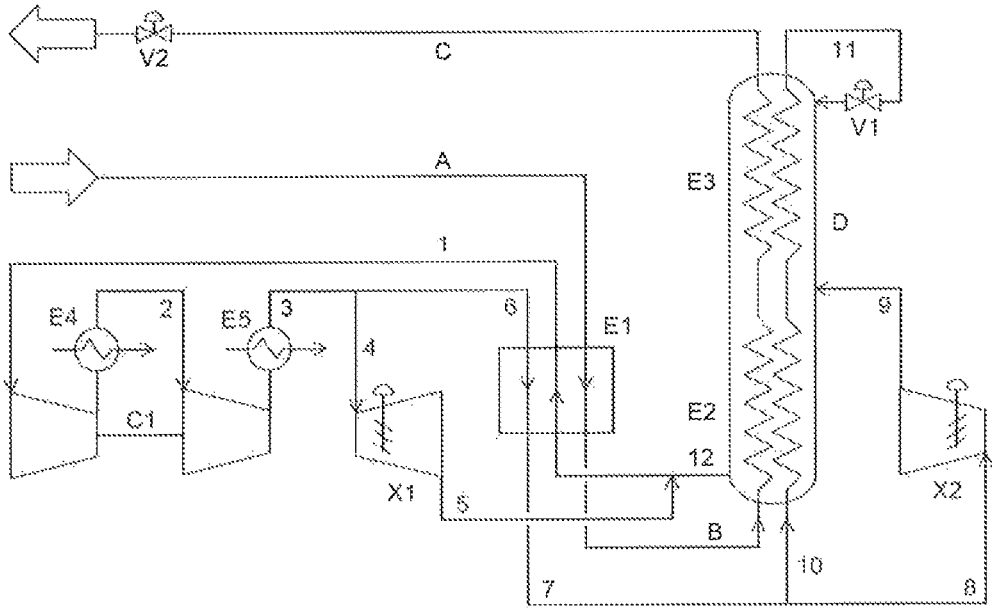
V2
C
11
V1
A
E3
D
1
E4
2
E5
3
6
E1
9
4
C1
E2
12
X1
5
X2
B
10
7
8

PROCESS FOR COOLING A HYDROCARBON-RICH FRACTION

CROSS REFERENCE TO RELATED APPLICATIONS

This application claims priority from DE Patent Application DE102014012316.2 filed on Aug. 19, 2014.

BACKGROUND OF THE INVENTION

The invention relates to a process for cooling a hydrocarbon-rich fraction, in particular natural gas.

For the liquefaction of hydrocarbon-rich gas fractions, in particular natural gas, inter alia processes are employed in which the work-producing expansion of gases is utilized to generate refrigeration. To increase the thermodynamic efficiency, and thereby to reduce the specific energy consumption, more than one expansion turbine can be used. A shared characteristic of what are termed "multi-expander processes" is the separate provision of peak refrigeration (lowest refrigerant temperature) solely by sensible heat of a gas stream cooled by work-producing expansion and, independently thereof, the provision of the predominant part of the total required refrigeration output at a lower temperature level by using at least one further expansion turbine. Such expander processes are disclosed, for example, by U.S. Pat. No. 5,768,912, which discloses what is termed a double-$N_2$ expander process, and also U.S. Pat. No. 6,412,302, which describes what is termed a $N_2$—$CH_4$ expander process.

The expander operated at the lowest temperature level, however, in this case only contributes at about 25%, typically less than 20%, to the total refrigeration output. As result, the majority of the cooling work remains with the warm expander or expanders, if more than two expanders are used.

The object of the present invention to specify a process for cooling a hydrocarbon-rich fraction, in particular natural gas, in which the refrigeration output can be distributed more evenly when two expanders are used,—in this case, the ratio is preferably 40/60 to 60/40—in order, at a given maximum size of the expanders, to increase the capacity of the liquefaction process without using parallel expanders. In addition, the use of separate refrigeration circuits, as described in the abovementioned U.S. Pat. No. 6,412,302, is to be rejected, in order to keep the capital costs low.

SUMMARY OF THE INVENTION

To achieve this object, a process is proposed for cooling a hydrocarbon-rich fraction, in particular natural gas, against a refrigerant circuit, in which a) the hydrocarbon-rich fraction is cooled in three heat-exchange zones against the refrigerant of the refrigerant circuit, b) the refrigerant is compressed and then a first substream is branched off, while the residual refrigerant stream is cooled in the first heat-exchange zone against itself to a temperature which is at least 3° C., preferably at least 5° C., above the critical temperature of the refrigerant, c) the first substream is work-producingly expanded, d) the cooled residual refrigerant stream is divided into a second substream and a third substream, e) the second substream is work-producingly expanded, wherein pressure and temperature are selected in such a manner that no liquid occurs during the work-producing final expansion, f) the third substream is cooled in the second and third heat-exchange zones against the work-producingly expanded second substream and against itself, to the extent that in a subsequent expansion a liquid fraction of at least 90 mol %, preferably at least 95 mol %, is established, g) the third expanded two-phase substream is at least partially vaporized, preferably completely vaporized, in the third heat-exchange zone, h) the work-producingly expanded second substream is added to the third substream and the refrigerant stream thus formed is further warmed up in the second heat-exchange zone and i) the work-producingly expanded first substream is added to the warmed-up refrigerant stream and the refrigerant stream is further warmed up in the first heat-exchange zone before another compression thereof.

The process according to the invention for cooling a hydrocarbon-rich fraction now likewise has a warm expander and a cold expander, in which refrigerant substreams are work-producingly expanded. The cold expander, however, in contrast to the processes of the prior art, is no longer used for generating the peak refrigeration. The consequence is that the operating point of the cold expander is shifted in such a manner that the refrigeration output of the two expanders is now in the desired ratio between 40/60 and 60/40. At a given maximum size of the expanders, this permits the plant capacity to be increased in comparison with the processes of the prior art, without using parallel expanders.

According to a further advantageous embodiment of the process according to the invention, a mixture which, in addition to nitrogen and methane, comprises at least one further component from the group CO, Ar, $O_2$, Kr, Xe, $C_2H_4$ and $C_2H_6$ is used as refrigerant, wherein nitrogen is present in a concentration of at least 50 mol %, preferably at least 60 mol %, and methane is present in a concentration of at least 10 mol %, preferably at least 20 mol %.

It is energetically advantageous to keep the suction pressure of the compressor responsible for compressing the refrigerant as high as possible. If it is desired to avoid liquid in the work-producingly expanded second refrigerant substream and simultaneously keep as much liquid as possible in the expanded third refrigerant substream, defined boundary conditions result, which are met optimally by the proposed refrigerant composition.

In a further development of the process according to the invention for cooling a hydrocarbon-rich fraction, it is proposed that the refrigerant is compressed to at least 5 bar, preferably to at least 10 bar, above the critical pressure. By means of this process procedure, a two-phase nature of the refrigerant in the high-pressure range is avoided, and the partial load capacity is improved.

BRIEF DESCRIPTION OF THE DRAWINGS

The process according to the invention for cooling a hydrocarbon-rich fraction and also further advantageous embodiments of the same will be described in more detail hereinafter with reference to the exemplary embodiment shown in the FIGURE.

DETAILED DESCRIPTION OF THE INVENTION

The hydrocarbon-rich gas fraction A that is to be cooled is cooled in the heat exchangers or heat exchanger zones E1, E2 and E3, and in the process optionally liquefied and subcooled or converted at a pressure above the critical pressure without a change of phase into a high-density fluid. In this case, the fraction that is to be liquefied is cooled (stream B) to the extent that, after the expansion in the valve V2 to a pressure of a maximum of 5 bar, preferably a maximum of 1.5 bar, predominantly liquid is formed, wherein the liquid fraction is at least 85 mol %, preferably at least 90 mol %.

The refrigeration circuit that serves to cool the hydrocarbon-rich fraction A, in addition to a single- or multistage compressor C1, has two expanders X1 and X2 and also an expansion valve V1. The refrigerant 1 circulating in this refrigeration circuit is compressed C1 in a multistage manner in the exemplary embodiment shown in FIG. 1, wherein corresponding intercoolers and aftercoolers E4 and E5 are provided. The refrigerant 3 that is compressed to the desired circulation pressure is separated into a first substream 4 and also a residual refrigerant stream 6. The first substream 4 is work-producingly expanded in what is termed the warm expander X1 and fed via line 5 to the refrigerant stream 12 which is still to be described. In this case the first substream 4 is preferably expanded to a pressure which is slightly above the suction pressure of the compressor C1. The pressure difference between the exit of the warm expander X1 and the intake of the compressor C1 of typically less than 1 bar is caused by the pressure drop in the apparatuses and lines. The refrigerant stream 6 is cooled in the first heat exchange zone E1 to a temperature which is at least 3° C., preferably at least 5° C., above the critical temperature of the refrigerant.

The refrigerant stream 7 that is cooled in this manner is then divided into a second substream 8 and a third substream 10. The second substream is work-producingly expanded in what is termed the cold expander X2, wherein pressure and temperature are selected in such a manner that during the work-producing expansion no liquid occurs. Again, there follows the expansion to a pressure slightly above the suction pressure of the compressor C1.

The third substream 10 is cooled in the second and third heat exchange zones E2 and E3 against the work-producingly expanded second substream 9 and against itself, to the extent that in the subsequent expansion of the cooled third substream 11 in the expansion valve V1, a liquid fraction of at least 90 mol %, preferably at least 95 mol %, is established.

The expanded two-phase substream 11 is then at least partly, preferably completely, vaporized in the third heat-exchange zone E3. At the warm end of the heat-exchange zone E3, the expanded second substream 9 is added thereto and the refrigerant stream thus formed is warmed up further in the second heat-exchange zone E3. Finally, the work-producingly expanded first substream 5 is added to this refrigerant stream 12 before the entire refrigerant stream, upstream of the fresh compression C1 thereof, is warmed up to ambient temperature in the heat-exchange zone E1.

The mechanical output of one or both expanders X1 and X2 can optionally be used to drive generators or to drive booster compressors which relieve the circuit compressor C1. The booster compressors can be arranged in series or parallel, or can be used upstream or downstream of the compressor C1.

Suitable heat exchangers E1, E2 and E3 are all types which permit a counterflow to the heat exchange. As shown in FIG. 1, the heat exchanger (zones) E2 and E3 can be constructed in a special embodiment in which the heat-exchange bundles E2 and E3 are built into a shared pressure vessel D in which the expanded refrigerant substreams 9 and 11 are warmed up on the shell side.

If the gas fraction that is to be cooled contains (heavy) components which are unwanted in the end product, the cooled hydrocarbon-rich fraction B can be subjected to removal of said components, for example by deposition or scrubbing, between the heat exchanger (zones) E1 and E2.

What we claim is:

1. A process for cooling a hydrocarbon-rich fraction against a refrigerant circuit in which a refrigerant flows, wherein the method comprises:

a) cooling the hydrocarbon-rich fraction in three heat-exchange zones against the refrigerant of the refrigerant circuit, b) compressing the refrigerant to form a compressed refrigerant, c) splitting the compressed refrigerant into a first substream and a residual refrigerant stream, d) cooling the residual refrigerant stream in the first heat-exchange zone against itself to a temperature which is at least 3° C. above the critical temperature of the refrigerant, e) work-producingly expanding the first substream, f) dividing the cooled residual refrigerant stream into a second substream and a third substream, g) work-producingly expanding the second substream in a final expansion stage to form a work-producingly expanded second substream, wherein pressure and temperature are selected in such a manner that no liquid occurs during the work-producing final expansion stage, h) cooling the third substream in the second and third heat-exchange zones to form a cooled third substream, i) expanding the cooled third substream to obtain an expanded two-phase third substream having a subsequent expansion a liquid fraction of at least 90 mol % is established, j) feeding the expanded two-phase third substream into the third heat-exchange zone so that it acts to cool the downstream third substream in the third heat exchange zone, wherein in the third heat-exchange zone the expanded, two-phase third substream is at least partially vaporized in the third heat-exchange zone, k) wherein the work-producingly expanded second substream combines with the at least partially vaporized third substream, and the refrigerant stream thus formed is further warmed up in the second heat-exchange zone to form a warmed-up refrigerant stream, l) adding the work-producingly expanded first substream to the warmed-up refrigerant stream, and m) warming up the refrigerant stream in the first heat-exchange zone before the up refrigerant stream is subjected again to the compression of step b).

2. The process according to claim 1 wherein the hydrocarbon-rich faction is natural gas.

3. The process according to claim 1, wherein the temperature in step b) is at least 5° C. above the critical temperature of the refrigerant.

4. The process according to claim 1, wherein in step f) a liquid fraction of at least 95 mol % is established.

5. The process according to claim 1, wherein in step g) the third expanded two-phase substream is completely vaporized.

6. The process according to claim 1, wherein a mixture which, in addition to nitrogen and methane, comprises at least one further component selected from the group consisting of CO, Ar, $O_2$, Kr, Xe, $C_2H_4$ and $C_2H_6$ is used as refrigerant, wherein nitrogen is present in a concentration of at least 50 mol % and methane is present in a concentration of at least 10 mol %.

7. The process according to claim 6, wherein the nitrogen is present in a concentration of at least 60 mol %.

8. The process according to claim 6, wherein methane is present in a concentration of at least 20 mol %.

9. The process according to claim 1, wherein in step b) the refrigerant is compressed to at least 5 bar above the critical pressure of the refrigerant.

10. The process according to claim 9, wherein in step b) the refrigerant is compressed to at least 10 bar above the critical pressure of the refrigerant.

* * * * *